United States Patent [19]

Becker

[11] 4,426,077

[45] Jan. 17, 1984

[54] MUSCLE DEVELOPING EXERCISE DEVICE

[76] Inventor: Hermann-Josef Becker, Hochstr. 52, 5521 Ferschweiler, Fed. Rep. of Germany

[21] Appl. No.: 245,468

[22] Filed: Mar. 19, 1981

[30] Foreign Application Priority Data

Mar. 25, 1980 [DE] Fed. Rep. of Germany ..... 3011404

[51] Int. Cl.[3] ..... A63B 21/04; A63B 21/08

[52] U.S. Cl. ..... 272/118; 272/130; 272/136; 272/141

[58] Field of Search ..... 272/136, 142, 135, 143, 272/DIG. 4, 117, 134

[56] References Cited

U.S. PATENT DOCUMENTS 3,638,941 2/1972 Kulkens ..... 272/142 X
4,129,297 12/1978 Dolan ..... 272/142 X

FOREIGN PATENT DOCUMENTS 604340 3/1960 Italy ..... 272/125

*Primary Examiner*—Richard C. Pinkham
*Assistant Examiner*—Matthew Schneider
*Attorney, Agent, or Firm*—Ward Brown; Robert W. Beach

[57] ABSTRACT

An elongated lever arm has one of its end portions pivotally connected to an upright of a box frame and extends generally horizontally inward into the frame opening. A cable guided by one or more pulleys or rollers is connected to the other end portion of the lever arm and is pulled manually by a user to swing the lever arm. A force-applying or resistance element is connected between the base of the frame and any one of several points along the length of the lever arm between its pivot and the cable. The point of connection of the resistance element to the lever arm can be changed to adjust its effective force resisting swinging of the lever arm. A mechanical stop mechanism is provided to maintain the lever arm horizontal and to counteract the force of the resistance element so that the force adjustment can be made quickly and easily.

15 Claims, 5 Drawing Figures

MUSCLE DEVELOPING EXERCISE DEVICE

The present invention pertains to an exercise device for developing human muscle power and, more specifically, an exercise device of the type having a swingable lever arm moved manually by the user against the force of a resistance element such as a spring or a set of weights.

A known muscle-developing exercise device has an upright lever arm the lower end portion of which is pivotally mounted on the base of a frame. A cable has an inner end portion secured to the upper end portion of the lever arm, an intermediate portion extending around a guide roller mounted on the frame and a free end portion carrying a handle for the user. A threaded rod extends parallel to and is carried by the lever arm. Such rod carries a nut mechanism the position of which is adjustable longitudinally of the rod and the lever arm. The force of springs connected between the nut mechanism and the frame oppose lateral movement of the upper portion of the lever arm.

In the known exercise device, the effective biasing or resistance force applied by the springs is adjusted by the time-consuming procedure of rotating the threaded rod to change the position of the nut mechanism. In addition, the force of the springs continues to be applied during this adjustment, which can made rotating the threaded rod difficult.

In contrast to this, it is an object of the present invention to provide a muscle-developing exercise device in which a resistance force can be easily and rapidly adjusted, preferably without variation of the starting position for a member moved manually by the user.

This and other objects are accomplished by the muscle-developing exercise device of the present invention shown by way of example in the accompanying drawings in which.

Figure 1:
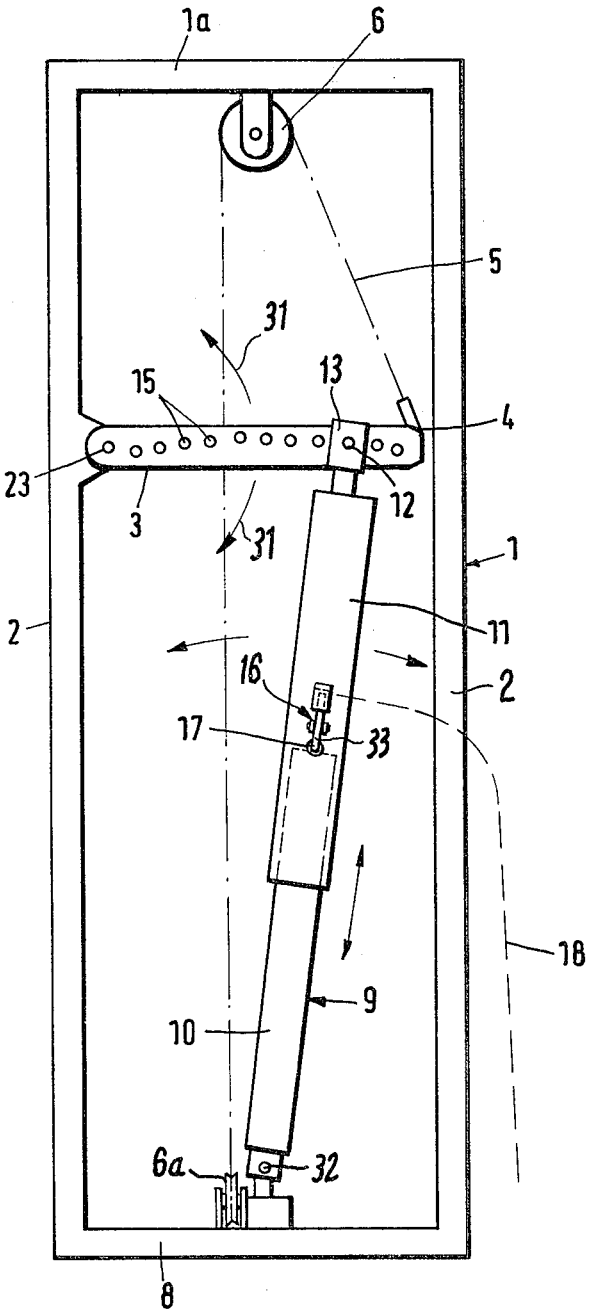
FIG. 1 is a somewhat diagrammatic front elevation of a muscle-developing exercise device in accordance with the present invention.
Figure 2:
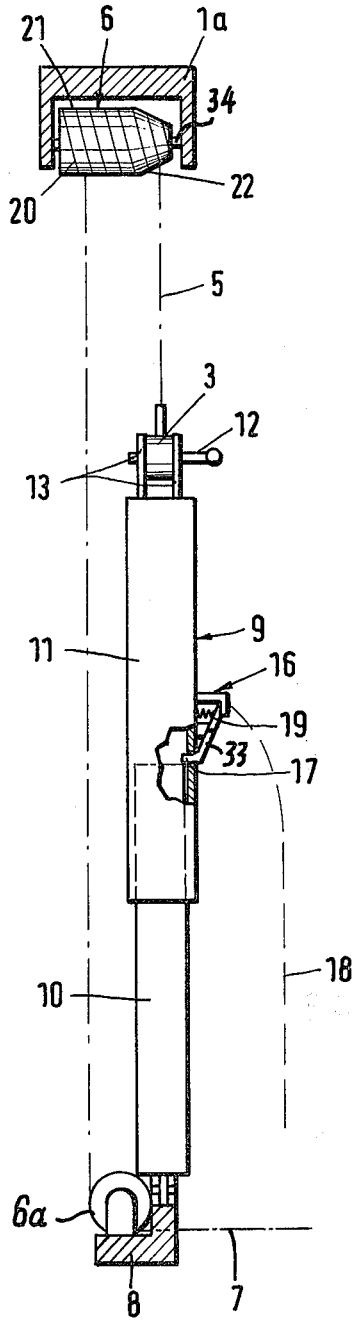
FIG. 2 is a largely diagrammatic side elevation of the muscle-developing exercise device of FIG. 1 with parts broken away and parts shown in section.

As shown in FIGS. 1 and 2, the muscle-developing exercise device in accordance with the present invention includes a box frame 1 having laterally spaced uprights 2 connected by a bottom or base crosspiece 8 and a top crosspiece 1*a*. One end portion of a normally horizontally extending lever arm 3 is pivotally connected to one of the uprights 2 enabling swinging movement of the lever arm in opposite senses from its central position as indicated by the arrows 31.

One end of a flexible force-transmitting device such as a cable 5 is connected to the swinging or free end portion 4 of the lever arm 3. From its connection to the lever arm, the cable extends upward over a guide roller 6 carried beneath the top crosspiece 1*a*, then downward behind the lever arm to a pulley 6*a* carried above the bottom crosspiece 8. The free end portion 7 of the cable extends horizontally outward from the frame, as seen in FIG. 2, and carries a handle or other traveling member, not shown, to be moved manually by the user.

An elongated resistance element 9 is connected between the bottom crosspiece 8 of the frame and the lever arm 3. Such resistance element includes a lower tube 10 having its bottom portion pivotally connected to the bottom crosspiece 8 and its upper portion slidably fitted in the bore of a somewhat larger upper tube 11. The top portion of the upper tube is pivotally connected to the lever arm 3. A force-applying member, such as a spring, a band of rubber or a gas piston, is fitted inside the tubes so as to apply a force opposing sliding movement of the upper tube 11 upward relative to the lower tube 10.

The upper end portion of the upper tube 11 is pivotally connected to the lever arm 3 by a pin 12 extending through any one of several holes 15 spaced longitudinally of the lever arm, as well as through registered holes in plates 13 projecting upward from the upper tube and straddling the lever arm as shown in FIG. 2. Preferably, the holes 15 are arranged in an arcuate row so as to be equidistant from the bottom pivot point 32 of the composite resistance element 9.

Locking mechanism 16 mounted on the upper tube 11 includes an upright latch lever 33 which is swingable about a point intermediate its ends. A spring 19 biases the upper end portion of the latch lever inward but, as indicated in FIG. 2, such upper end portion can be swung outward by use of a Bowden wire 18 so as to swing the lower end portion or "finger" 17 of the latch lever inward through a hole in the upper tube 11. In its inward swung position, the finger 17 engages against the upper end of the lower tube 10, preventing downward sliding movement of the upper tube 11 relative to the lower tube, regardless of the force applied by the force-applying member of the resistance element 9.

As also shown in FIG. 2, preferably the guide roller 6 has a generally helical outer groove 20 for receiving several wraps of the cable 5. From the end portion of the cable secured to the lever arm 3, first the cable is wrapped around a substantially conical section 22 of the roller 6, then around a substantially cylindrical section 21 of the roller. The roller 6 is freely rotatable on a short axle 34 supported beneath the frame upper crosspiece 1*a* and is slidable laterally of the cable.

In use, the user exerts a tension force on the free end portion 7 of the cable 5, which force is applied to the outer end portion of the lever arm at its point of connection to the cable. The force required to swing the lever arm upward in opposition to the force applied by the resistance element 9 depends on the distance from the pivot point 23 of the lever arm to the point of connection of the resistance element to the lever arm. For adjusting the force required to swing the lever arm upward, the locking mechanism 16 can be actuated to prevent downward sliding movement of the upper tube 11. Accordingly, with the lever arm maintained horizontal, the attachment pin 12 can be removed, and the resistance element can be swung laterally to register another of the lever arm holes 15 with the holes through the plates 13, whereupon the pin 12 can be reinserted. The entire adjustment operation is accomplished without varying the position of the lever arm and without having to apply additional force to prevent downward sliding movement of the upper tube 11.

The effect of the conical section of the guide roller 6 is to progressively reduce the pulling force required to raise the lever arm as it swings upward.

Figure 3:
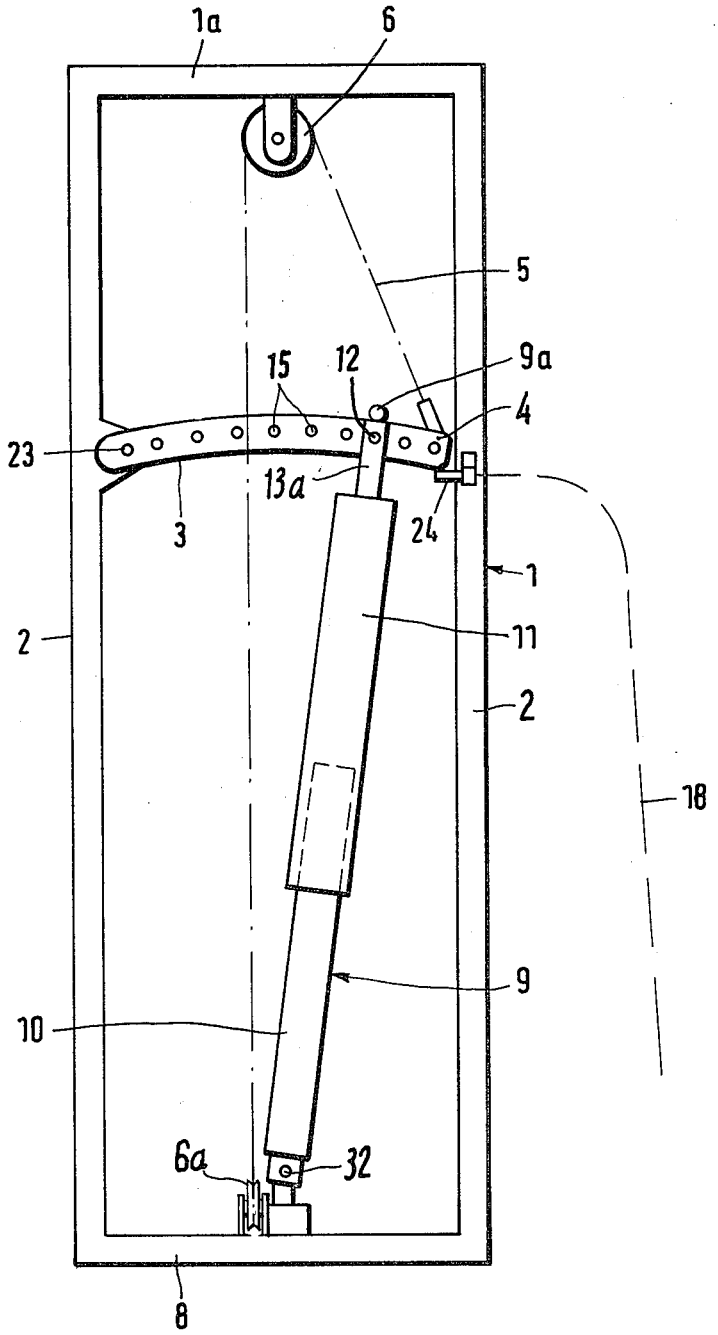
FIGS. 3, 4 and 5 are corresponding somewhat diagrammatic front elevations of alternative embodiments of muscle-developing exercise devices in accordance with the present invention.

In the alternative embodiment shown in FIG. 3, rather than providing the tube-mounted locking mechanism 16 shown in FIGS. 1 and 2, a swingable stop 24 is mounted on an upright 2 of the exerciser frame and is movable by use of a Bowden wire 18 to a position engaging the underside of the swinging end portion 4 of the lever arm 3 to retain the lever arm in approximately horizontal position regardless of the force applied by the resistance element 9. The brackets 13*a* projecting upward from the resistance element upper tube 11 carry a small wheel 9*a* rollable along the arcuate upper periphery of the lever arm which, in the horizontal position of the lever arm, forms a segment of a circle centered over the pivot 32 of the resistance element. During normal use, the stop 24 is swung out of the path of movement of the lever arm.

Figure 4:
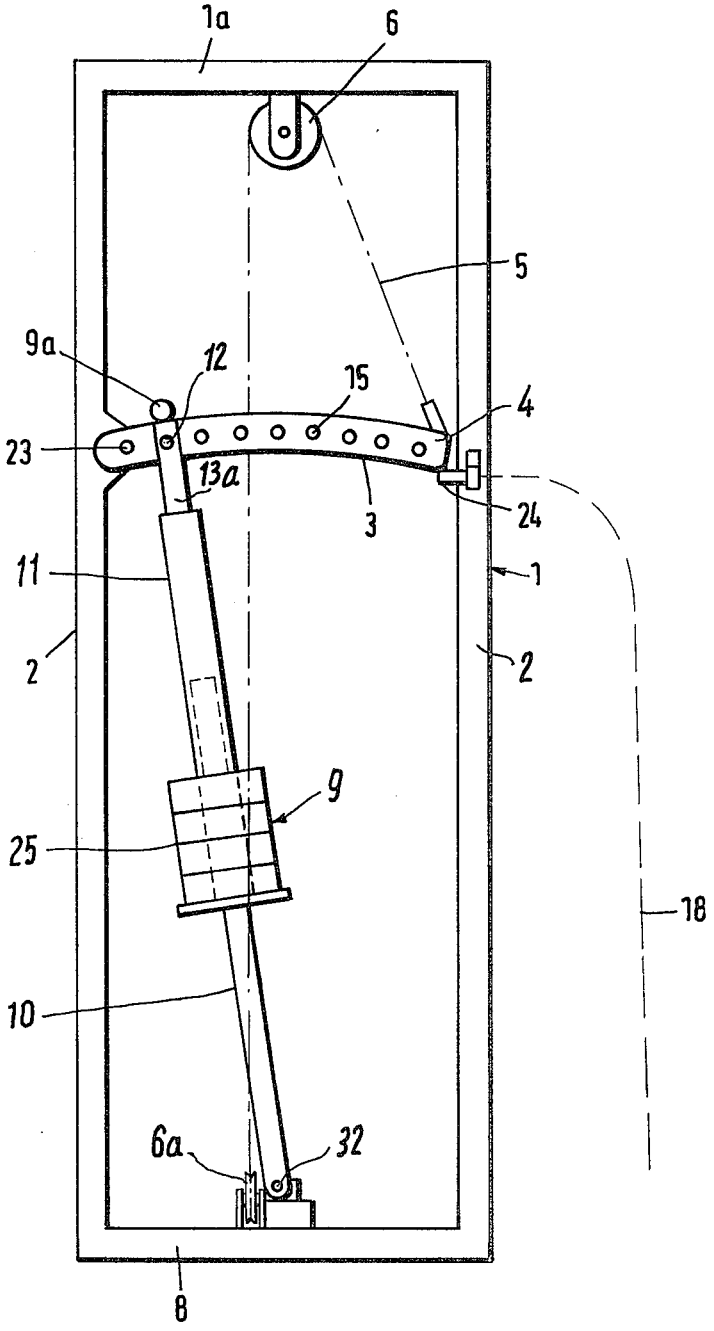

The alternative embodiment shown in FIG. 4 is identical to the embodiment shown in FIG. 3 with the exception that the force-applying member of the resistance element 9 is in the form of a set 25 of weights carried by the upper tube 11 for movement therewith.

Figure 5:
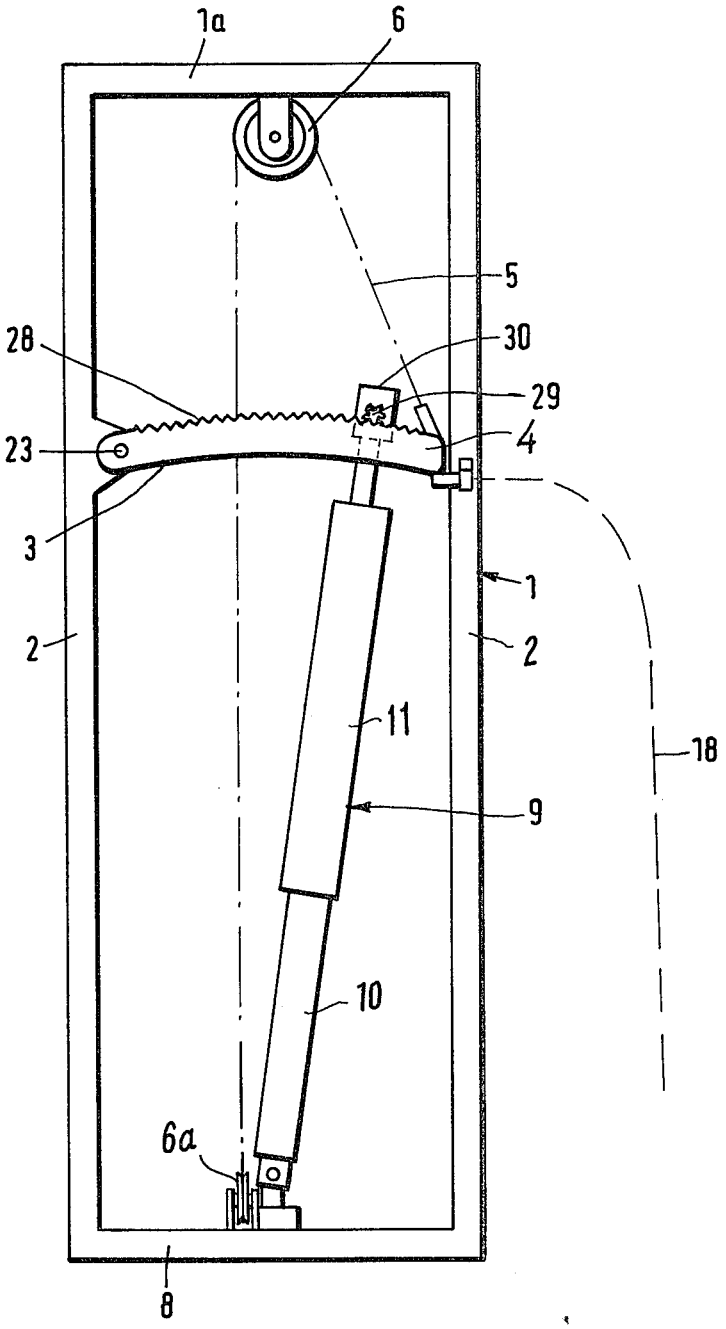

The alternative embodiment shown in FIG. 5 also is quite similar to the embodiment of FIG. 3, the exception being that the upper surface 28 of the lever arm 3 forms an arcuate segment gear having teeth meshing with the teeth of a pinion 29 turnable by a servomotor 30 mounted on the rear plate 13*b* projecting upward from the upper tube 11. Again, a swingable stop 24 is provided to retain the lever arm 3 in generally horizontally extending position as the pinion 29 is rotated by the servomotor to swing the resistance element 9 and change the location at which its force is applied. Alternatively, a hand crank can be provided to rotate the pinion.

I claim:

1. In a muscle-developing exercise device the improvement comprising the combination of a frame member, a lever arm member for being moved manually by a user and pivotally mounted on said frame member for swinging in opposite senses from a central position, a resistance member for applying a force tending to swing said lever arm member in one sense from its central position and resisting swinging of said lever arm member in the other sense from its central position, said resistance member being connectible to said lever arm member at any selected one of a plurality of locations for adjusting the effective resisting force of said resistance member, and stop means pivotally connected to and mounted on one of said members and swingable to a position to offset the force applied by said resistance member when said lever arm member is in its central position, the location of the connection of said resistance member to said lever arm member being adjustable while the force of said resistance member is offset by said stop means.

2. In the exercise device defined in claim 1, the resistance member being connected between the frame member and the lever arm member and changing in effective length as the lever arm member is moved from its central position.

3. In the exercise device defined in claim 2, the lever arm member being elongated and having one end portion pivotally connected to the frame member, a flexible force-transmitting device connected to the other end portion of the lever arm member, and a traveling member carried by the flexible force-transmitting device for being pulled manually by a user to move the lever arm member.

4. In the exercise device defined in claim 2, the resistance member including a first tube pivotally connected to the lever arm member, a second tube pivotally connected to the frame member, one of said tubes having an end portion received in the bore of the other of said tubes, and force-applying means for resisting relative sliding movement of said tubes in a given direction.

5. In the exercise device defined in claim 4, the force-applying means including a weight carried by the first tube for movement therewith and, by gravity, normally applying a downward force on the first tube and the lever arm member.

6. In the exercise device defined in claim 2, the stop means being pivotally mounted on the frame member and being swingable from a position out of the path of movement of the lever arm member to a position in the path of movement of the lever arm member.

7. In the exercise device defined in claim 2, the lever arm member and the resistance member being constructed and arranged relatively so that, with the lever arm member maintained in its central position, the location of connection of the resistance member to the lever arm member can be adjusted without substantial change in the effective length of the resistance member.

8. In the exercise device defined in claim 7, one side of the lever arm member forming an arc member, and a roller carried by the resistance member for rolling along such lever arm side.

9. In the exercise device defined in claim 2, one side of the lever arm member forming a gear segment, a pinion carried by the resistance member for meshing with said gear segment, and means for rotating said pinion to move the resistance member relative to the lever arm member.

10. In a muscle-developing exercise device, the improvement comprising the combination of a frame, an elongated lever arm for being moved manually by a user and having one end portion pivotally connected to said frame for swinging in opposite senses from a central position of said lever arm, resistance means connected between said frame and said lever arm for applying a force tending to swing said lever arm in one sense from its central position and resisting swinging of said lever arm in the other sense from its central position, said resistance means changing in effective length as said lever arm is moved, a flexible force-transmitting device connected to the other end portion of said lever arm, a traveling member carried by said flexible force-transmitting device for being pulled manually by a user to move said lever arm, and a guide roller carried by said frame and having a generally helical outer groove for receiving several wraps of said flexible force-transmitting device between its connection to said lever arm and its connection to said traveling member, at least a portion of the helix defined by said generally helical groove changing in diameter axially of said roller.

11. In the exercise device defined in claim 10, an axle carried by the frame and mounting the roller for sliding movement laterally of the flexible force-transmitting device.

12. In a muscle-developing exercise device, the improvement comprising the combination of a frame, a lever arm for being moved manually by a user and pivotally mounted on said frame for swinging in opposite senses from a central position of said lever arm, resistance means connected between said frame and said lever arm for applying a force tending to swing said lever arm in one sense from its central position and resisting swinging of said lever arm in the other sense from its central position, said resistance means changing in effective length as said lever arm is moved from its central position and including a first tube and a second tube, one of said tubes having an end portion received in the bore of the other of said tubes, said first tube being pivotally connectible to said lever arm at any selected one of a plurality of locations for adjusting the effective resisting force of said resisting means and said second tube being pivotally connected to said frame, said resistance means further including force-applying means for resisting relative sliding movement of said tubes in a given direction, and a stop means pivotally mounted on one of said tubes and swingable to a position so as to engage against a portion of the other tube to prevent relative sliding movement of the tubes in a given direction when the lever arm is in its central position so that the location of connection of said first tube to the lever arm can be adjusted while the force of the force-applying means is offset by said stop.

13. In the exercise device defined in claim 12, spring means for biasing the stop means to a position out of engagement with the other tube.

14. In a muscle-developing exercise device, the improvement comprising the combination of a frame, a lever arm for being moved manually by a user and pivotally connected to said frame for swinging in opposite senses from a central position of said lever arm, resistance means connected between said frame and said lever arm for applying a force tending to swing said lever arm in one sense from its central position and resisting swinging of said lever arm in the other sense from its central position, said resistance means changing in effective length as said lever arm is moved from its central position and being connectible to said lever arm at any selected one of a plurality of locations for adjusting the effective resisting force of said resistance means, stop means selectively actuatable for offsetting the force applied by the resistance means when the lever arm is in its central position, the location of connection of the resistance means to the lever arm being adjustable while the force of the resistance means is offset by said stop means, said lever arm having an arcuate row of spaced holes defining a segment of a circle centered on the point of connection of the resistance means to the frame and the resistance means including a portion having holes registrable with any selected one of said lever arm holes, and a pin for extending through said lever arm and resistance means holes to pivotally connect the resistance means to the lever arm so that, with said lever arm member maintained in its central position, the location of connection of said resistance means to said lever arm can be adjusted without substantial change in the effective length of said resistance means.

15. In a muscle-developing exercise device, the improvement comprising the combination of a frame, an elongated lever arm for being moved manually by a user and pivotally connected to said frame for swinging in opposite senses from a generally horizontally extending central position of said lever arm, resistance means connected between said frame and said lever arm for applying a force tending to swing said lever arm is one sense from its central position and resisting swinging of said lever arm in the other sense from its central position, said resistance means being connected to said frame at a location generally centered between the ends of said lever arm and changing in effective length as said lever arm is moved from its central position, said resistance means being connectible to said lever arm at any selected one of a plurality of locations for adjusting the effective resistance force of said resistance means, and stop means selectively actuatable for offsetting the force applied by said resistance means when said lever arm is in its central position, the location of the connection of said resistance means to said lever arm being adjustable while the force of said resistance means is offset by said stop means.

* * * * *